US008303129B1

(12) United States Patent
Thielen

(10) Patent No.: US 8,303,129 B1
(45) Date of Patent: Nov. 6, 2012

(54) WRIST-MOUNTED ILLUMINATION DEVICE

(76) Inventor: Scott Thielen, Jacksonville, FL (US)

( * ) Notice: Subject to any disclaimer, the term of this patent is extended or adjusted under 35 U.S.C. 154(b) by 404 days.

(21) Appl. No.: 12/813,204

(22) Filed: Jun. 10, 2010

(51) Int. Cl.
*F21V 21/08* (2006.01)

(52) U.S. Cl. ..... 362/103; 362/104; 362/105; 362/106; 362/107; 362/108

(58) Field of Classification Search ..... 362/570–571, 362/103–108
See application file for complete search history.

(56) References Cited

U.S. PATENT DOCUMENTS

| | | | | |
|---|---|---|---|---|
| 1,769,241 | A | 7/1930 | Stephani | |
| 4,319,309 | A * | 3/1982 | Benoit | 362/108 |
| 4,788,631 | A | 11/1988 | Fuller | |
| D324,579 | S | 3/1992 | Crabtree, Jr. | |
| 5,154,506 | A | 10/1992 | Leard | |
| D344,411 | S | 2/1994 | Henry et al. | |
| 5,601,356 | A | 2/1997 | McWilliams | |
| 6,213,619 | B1 | 4/2001 | Yu | |
| 6,550,930 | B1 | 4/2003 | Portouche | |
| 6,715,897 | B2 * | 4/2004 | Rowe et al. | 362/103 |
| 6,880,951 | B2 | 4/2005 | Yoon | |
| 7,857,478 | B1 * | 12/2010 | Keller | 362/103 |

* cited by examiner

*Primary Examiner* — William Carter
(74) *Attorney, Agent, or Firm* — Montgomery Patent & Design, LLC; Robert C. Montgomery; Joseph Yaksich

(57) ABSTRACT

A dual-ended illumination device that is fastened to a user's wrist is herein disclosed, comprising a small cylindrical flashlight having a first end with at least three (3) white light-emitting diodes (LED's) and a second end having at least one (1) red LED. A four position switch located at a midpoint on a housing provides for OFF-WHITE-RED-BOTH positions. The flashlight attaches to one's wrist by use of a nylon strap secured with a fastening means. It is positioned on either the inside or outside of the wrist to suit a desired illumination need. An inside position would be used when reading a book, or performing physical tasks. The outside position would be used when riding or bike or walking, with perhaps all lamps illuminated to serve as a warning light to others. The device is viewed as being especially valuable in areas where it is impossible to hold a flashlight or have others hold one while performing work with both hands.

17 Claims, 2 Drawing Sheets

WRIST-MOUNTED ILLUMINATION DEVICE

RELATED APPLICATIONS

The present invention was first described in a notarized Official Record of Invention on Jun. 26, 2009, that is on file at the offices of Montgomery Patent and Design, LLC, the entire disclosures of which are incorporated herein by reference.

FIELD OF THE INVENTION

The present invention relates generally to personal lighting means such as flashlights, and in particular, to an illumination device specifically adapted for hands free use by a single user.

BACKGROUND OF THE INVENTION

In many circumstances such as unforeseen car maintenance, outdoors tasks performed in the evening, and the like, persons are required to complete a complicated task with their hands while working in near dark conditions. A common practice is to utilize a flashlight in order to provide additional, temporary illumination. However, this typically means trying to balance the flashlight under one's chin or on a nearby object in order to allow the use of both hands to perform the task. Another common practice is for a second person to help hold the flashlight. This obviously does not help situations in which a single person wishes to complete a task in poor lighting. Furthermore, this method expends the time and effort of a second person, and oftentimes the beam wanders about as the holder looses attention.

Other times the use of a flashlight is needed to serve as a warning of presence such as when walking or riding a bike along a roadway, or for the purposes of directing traffic. Once again, the process of a single user holding a flashlight is cumbersome or impossible. Overall, the need to hold a flashlight limits a user's ability to have hands free to perform other tasks and may even compromise their safety.

Various attempts have been made to provide an illuminating means for use by a single user. Examples of these attempts can be seen by reference to several U.S. patents. U.S. Pat. No. 1,769,241, issued in the name of Stephani, describes a device which allows for the attachment of a flashlight along a user's forearm.

U.S. Pat. No. 6,213,619, issued in the name of Yu, describes a wrist mounted light which provides a means for attachment of a rotating light source to a user's arm.

U.S. Pat. No. 6,550,930, issued in the name of Portouche, describes a wrist mounted illumination apparatus providing a means for illumination in front of a user in a hands free manner.

Additionally, ornamental designs for a wrist mounted light source exist, particularly U.S. Pat. Nos. D 324,579 and D 344,411. However, none of these designs are similar to the present invention.

While these devices fulfill their respective, particular objectives, each of these references suffer from one (1) or more of the aforementioned disadvantages. Many such devices do not provide a full range of adjustability to a user. Also, many such devices are not controllable by a user in accordance with varying situations and desired functions. Furthermore, many such devices are not provided with a means for selectively adjusting functionality based upon desired operating conditions and situations. Accordingly, there exists a need for a wrist mounted illumination device without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide hands free illumination capabilities to a single user which are applicable and customizable to suit a wide variety of common low light functions. Thus, the object of the present invention is to solve the aforementioned disadvantages and provide for this need.

To achieve the above objectives, it is an object of the present invention to provide a single user with a means for providing hands free illumination in their vicinity for purposes of lighting and visibility. The apparatus comprises an enclosure which provides a housing means to a plurality of light-emitting diodes arranged in a reflector assembly.

Another object of the present invention is to mount to the arm of a user in a manner which provides a hands free and unobstructed lighting means to the user. The apparatus is mounted via a textile strap and standoff spacer, with the spacer providing spatial separation between a user's arm and the light sources in order to prevent blockage of the light.

Yet still another object of the present invention is to provide a comfortable and selectable fit via adjustment of the straps with a conventional fastening means.

Yet still another object of the present invention is to provide multiple lighting means and configurations. One (1) end of the enclosure comprises a clear lens assembly which provides forward illumination. An opposite end of the enclosure comprises a colored lens assembly available in multiple colors dependent upon the task or job function being performed.

Yet still another object of the present invention is to comprise a waterproof compartment cover to allow the apparatus to be utilized in wet conditions without risk of damage or failure.

Yet still another object of the present invention is to allow a user to provide a desired configuration of colored lighting via an interchangeable colored lens assembly.

Yet still another object of the present invention is to provide further customizability and functionality via a flashing module. The flashing module comprises an electronic control for providing alternating flashing or strobing patterns to the colored lens assembly.

Yet still another object of the present invention is to provide a multi-positional control switch which provides a user with a means for selectively turning on and off the clean lens assembly, colored lens assembly, or a combination thereof. A secondary control switch provides an actuation means to the flashing module.

Yet still another object of the present invention is to provide a battery compartment which allows a user to easily replace a battery power source as needed.

Yet still another object of the present invention is to provide a method of utilizing the device that provides a unique means of selectively customizing the apparatus for a desired application via the flashing module and interchangeable colored lens assembly, comfortably fastening the apparatus to a desired wrist, inner arm, forearm, or other location via the textile strap, selectively turning the apparatus on an off as desired via the control switches, providing hands free illumination to a desired area for purposes of lighting or visibility, easily turning the apparatus off and removing it for storage or the like, and easily replacing the battery power source as needed.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
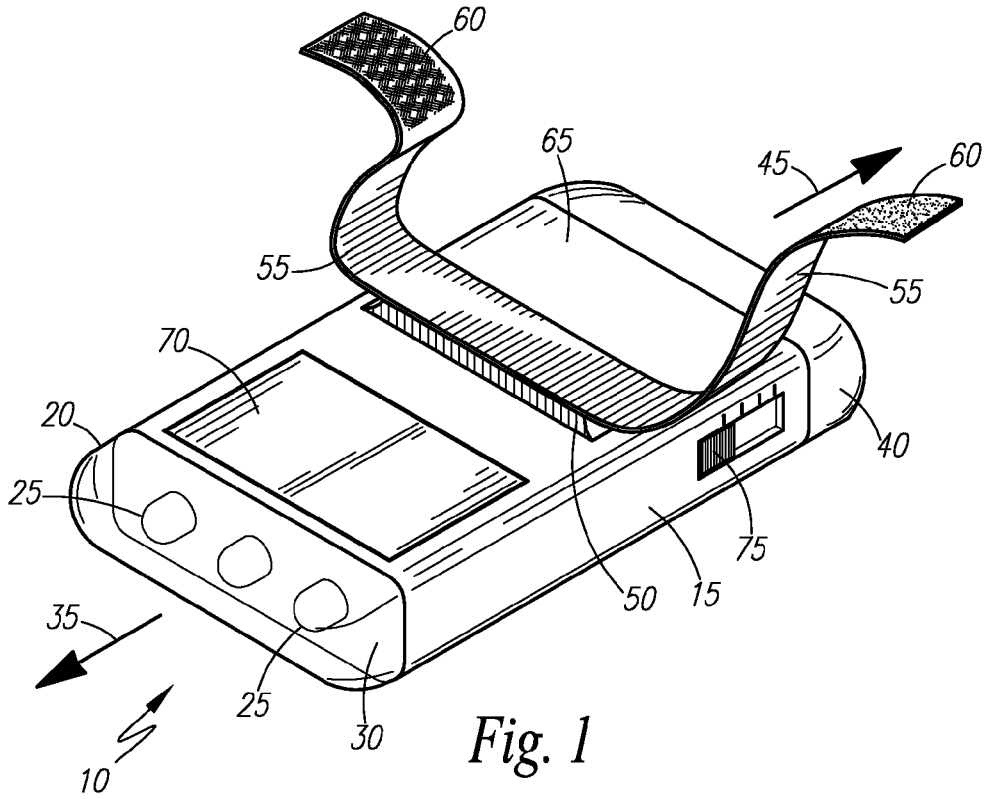
FIG. 1 is an isometric view of the wrist-mounted illuminating and visual warning apparatus 10, according to the preferred embodiment of the present invention.

10 wrist-mounted illuminating and visual warning apparatus
15 enclosure
20 clear lens assembly
25 light-emitting diodes (LED's)
30 reflector assembly
35 first light path
40 colored lens assembly
45 second light path
50 standoff spacer
55 textile strap
60 adjustable fastening system
65 rear surface
70 battery compartment cover
75 control switch
80 flashing module
85 secondary control switch
90 forearm
95 wrist area
100 elbow area
105 set of internal batteries
110 blocking diodes
115 LED driver circuit

DETAILED DESCRIPTION OF THE PREFERRED EMBODIMENT

Figure 2:
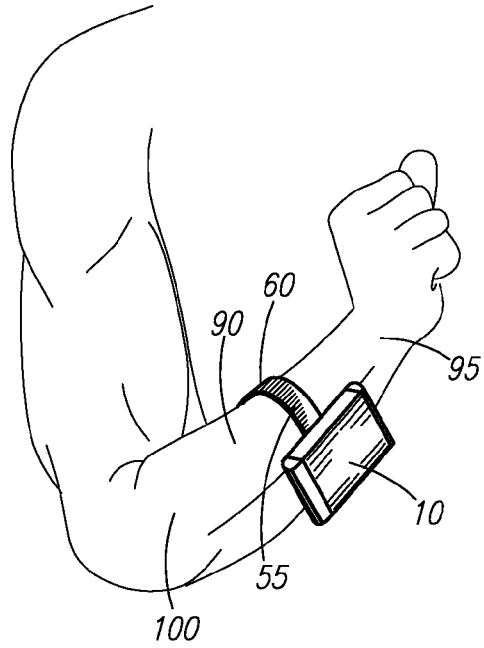
FIG. 2 is an isometric view of the wrist-mounted illuminating and visual warning apparatus 10, shown in an utilized state upon an forearm 90 according to the preferred embodiment of the present invention.
Figure 3:
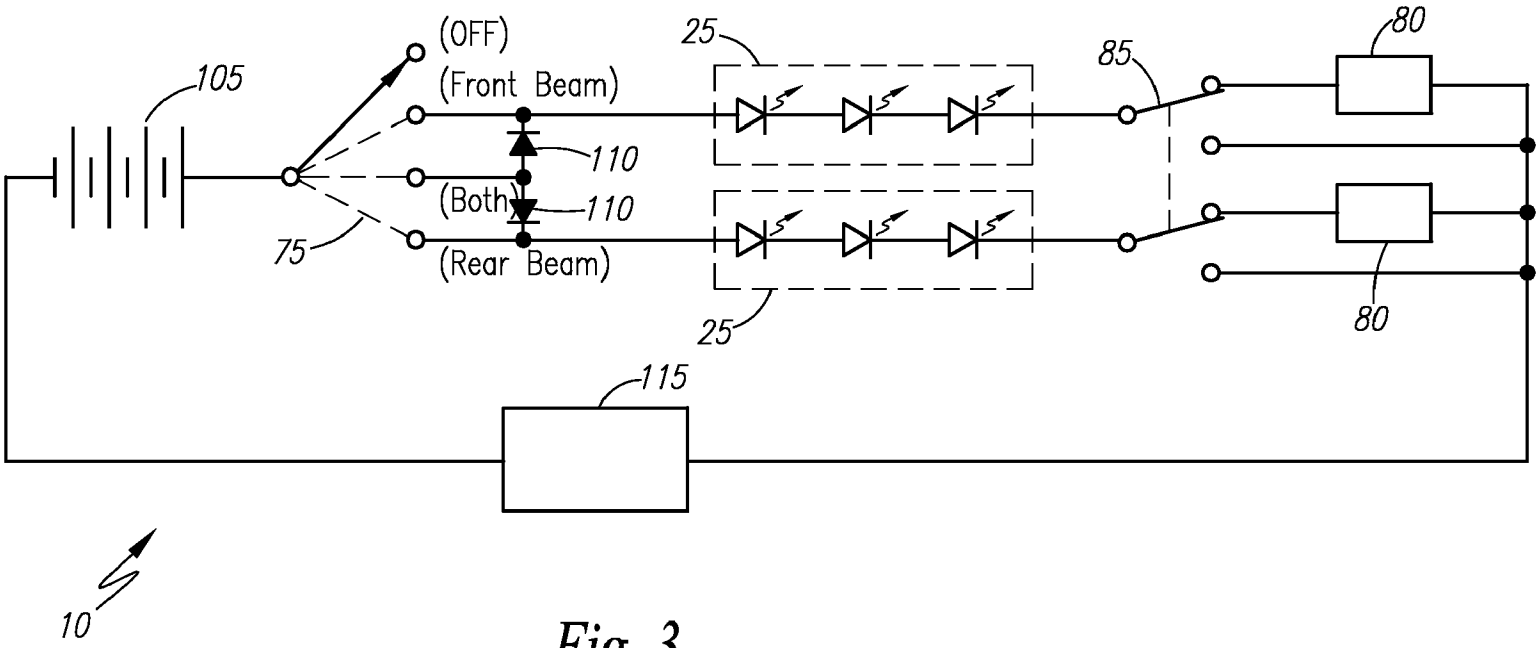
FIG. 3 is an electrical block diagram which depicts the major electrical components of the wrist-mounted illuminating and visual warning apparatus 10, according to the preferred embodiment of the present invention.

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, an isometric view of the wrist-mounted illuminating and visual warning apparatus 10, according to the preferred embodiment of the present invention, is disclosed. The apparatus comprises an enclosure 15 that is oblong in cross-section. It is approximately five (5) inches long, two (2) inches wide and three-quarters (¾) of an inch thick. The enclosure 15 would most likely be made of impact-resistant plastic, although other materials such as aluminum, fiberglass and the like could also be used with equal effectiveness thus not presenting a limiting factor of the present invention. One (1) end of the enclosure is provided with a clear lens assembly 20 which houses a plurality of light-emitting diodes (LED's) 25 arranged in a reflector assembly 30 such that the emitted light from the light-emitting diodes (LED's) 25 is projected forward along a first light path 35. The opposite end of the enclosure is provided with a colored lens assembly 40 also housing light-emitting diodes (LED's) 25 and a reflector assembly 30 thus producing a second light path 45 which is aligned one hundred eighty degrees (180°) with the first light path 35. It is envisioned that the colored lens assembly 40 could be available in multiple colors such as red, blue, amber or the like, dependent on the task or job function being performed by the user. Examples include the use of the red color for use while walking or riding a bicycle during diminished light or at night. The use of the color blue could be reserved for law enforcement officers who may be responding to a traffic condition or emergency situation along a roadway where it is important that oncoming vehicles are aware of their presence. The use of the amber color could be used for on job sites and construction sites to illuminate the presence of fellow workers in dim or dark lighting conditions. The exact configuration of the color utilized would be determined by the final user and may be made using various interchangeable colored lens assemblies 40, or may also be accomplished by utilizing light-emitting diodes (LED's) 25 which provide different illuminating colors such as, but not limited to: red, blue, amber, and the like. The wrist-mounted illuminating and visual warning apparatus 10 is mounted to the arm of a user (as will be further detailed herein below) by the use of a standoff spacer 50 and a textile strap 55. The standoff spacer 50 ensures that the wrist-mounted illuminating and visual warning apparatus 10 is positioned away from the user's arm thus permitting no blockage of the first light path 35 or the second light path 45 to occur from the user's arm, shirt, jacket or coat. The textile strap 55 would be made of durable fabric material such as nylon which will withstand physical elements such as ultraviolet (UV) radiation, water, abrasion, and the like. The textile strap 55 is fastened upon itself by the use of an adjustable fastening system 60 such as hook-and-loop-type fastener (VELCR®), snaps, clips, or the like. Said adjustable fastening system 60 is well-known in the art and is not intended to be a limiting factor of the present invention. A rear surface 65 is provided with a battery compartment cover 70 which houses user replaceable batteries. The use of light-emitting diodes (LED's) 25 ensures low power draw and long operating life between replacements of the battery. The battery compartment cover 70 is of a waterproof design and can withstand immersion without leakage of water into the interior of the enclosure 15. Finally, a control switch 75 is located on the side of the enclosure 15. The control switch 75 is envisioned to be of a four-position design that provides for OFF-FRONT BEAM (WHITE)-BOTH-REAR BEAM (COLORED) positions. It is also envisioned that the rear beam or colored beam would be provided with a flashing or strobe module to allow the light-emitting diodes (LED's) 25 as provided as part of the colored lens assembly 40 to flash on and off. Additionally, alternating colors such as red and blue are also envisioned in a flashing or alternating format. Said functionality of alternating colors is well-known in the art and as such, should not present a limiting factor of the present invention. Such flashing ability would be provided by a flashing module 80 (not seen in this configuration) and a secondary control switch 85 (not seen in this configuration).

Referring next to FIG. 2, an isometric view of the wrist-mounted illuminating and visual warning apparatus 10, shown in a utilized state upon a forearm 90 according to the preferred embodiment of the present invention, is depicted. The wrist-mounted illuminating and visual warning apparatus 10 can be located anywhere upon the forearm 90 form the wrist area 95 to the elbow area 100. One simply adjusts the textile strap 55 with the adjustable fastening system 60 to position it anywhere as needed to produce the appropriate light pattern. Additionally, it can be placed on either the inside portion of the forearm 90 (closest to the user's torso) or on the outside portion of the forearm 90 (away from the user). An inside position would be most likely used when reading a book, or performing physical tasks. The outside position would be most likely used when riding or bike or walking, with perhaps all lamps illuminated to serve as a warning light to others. Said outside position would be most likely used with the flashing module 80 (as shown in FIG. 1). The device is viewed as being especially valuable in areas where it is impossible to hold a flashlight or have others hold one (1) while performing work with both hands. It is also viewed as a useful tool or implement that would be used by law enforcement officers while performing various tasks of their job.

Referring finally, to FIG. 3, an electrical block diagram which depicts the major electrical components of the wrist-mounted illuminating and visual warning apparatus 10, according to the preferred embodiment of the present invention is shown. Power for the wrist-mounted illuminating and visual warning apparatus 10 is provided by a set of internal batteries 105 routed through the control switch 75. The control switch 75 functions as a single pole four-position switch. A pair of blocking diodes 110 prevents the flow of to the light-emitting diodes (LED's) 25 of the clear lens assembly 20 or the colored lens assembly 40 when the control switch 75 is in one (1) of two (2) positions that is intended to illuminate only one (1) lamp. When in the "BOTH" position, the current will flow to both light-emitting diodes (LED's) 25 arrays. The flashing module 80 is then placed in series with this circuit allowing for flashing or strobing abilities and controlled by the secondary control switch 85, herein depicted as a double-pole, double throw switch. It should be noted that the circuit described herein is a simple variation of a combination parallel/series circuit and as such, can be designed in multiple different variations by those familiar in the art to achieve the end results. As such, the exact circuit description should not be interpreted as a limiting factor of the present invention. Current for the light-emitting diodes (LED's) 25 is regulated by a LED driver circuit 115. The LED driver circuit 115 is envisioned as an SSC P7 8x7135 2.8 A LED Driver Circuit Board as manufactured by Shenzhen Yutengxiang Technology Co., Ltd. in Guangdong, China or equivalent. The flashing module 80 could be made of a LM555 timer circuit as manufactured by the Fairchild Semiconductor Corporation or equal and combined with a driving transistor or MOSFET.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. It is envisioned that the wrist-mounted illuminating and visual warning apparatus 10 would be constructed in general accordance with FIG. 1 through FIG. 3.

After procurement, the user would place a set of set of internal batteries 105 within the battery compartment cover 70 and secure them in place. Next the user would place the wrist-mounted illuminating and visual warning apparatus 10 about the forearm 90 in the desired location and fasten it in place using the textile strap 55 and the adjustable fastening system 60. Finally, the user would activate the wrist-mounted illuminating and visual warning apparatus 10 using the control switch 75 and flashing module 80 if so equipped to produce a constant or flashing beam of light from either the clear lens assembly 20, the colored lens assembly 40 or both. Such activation would depend upon the activating being performed by the user at the specific time. Any changes necessary to the operation of the wrist-mounted illuminating and visual warning apparatus 10 could be made at any point in time by simply revising the positioning of the control switch 75 and/or the secondary control switch 85. When completed with the use of the wrist-mounted illuminating and visual warning apparatus 10, it would be deactivated using the control switch 75, removed and stored away until needed again. When the set of internal batteries 105 are depleted from use, they can be replaced by the final user allowing usage to continue in an indefinite cyclical pattern.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A wrist-mounted illuminating visual warning device freely positional on a forearm of a user to provide a light pattern, said wrist-mounted illuminating visual warning device comprising:

an enclosure;

a clear lens assembly situated at one end of said enclosure;

a colored lens assembly interchangeably situated at another end of said enclosure opposite from said clear lens assembly;

a power source located at said enclosure;

a control switch electrically coupled to said power source;

a plurality of flashing modules;

a plurality of secondary control switches electrically coupled to said flashing modules respectively;

a plurality of blocking diodes electrically coupled to said control switch; and, a LED driver circuit electrically coupled to said power source and said flashing modules respectively;

wherein said clear lens assembly and said colored lens assembly cooperate with said flashing modules and said secondary control switches and thereby emit light along first and second light paths based upon a position of said control switch respectively.

2. The wrist-mounted illuminating visual warning device of claim 1, further comprising: a standoff spacer attached to a rear surface of said enclosure;

a textile strap attached to said standoff spacer; and an adjustable fastening system located at opposed ends of said textile strap;

herein said adjustable fastening system and textile strap are adapted to freely position said enclosure on the forearm of the user.

3. The wrist-mounted illuminating visual warning device of claim 2, wherein said standoff spacer is adapted to prevent said first light path and said second light path from being blocked by the forearm of the user.

4. The wrist-mounted illuminating visual warning device of claim 1, wherein said enclosure comprises: a battery compartment having a waterproof cover situated at said rear surface of said enclosure;

wherein said control switch is located on a side of said enclosure; and, wherein said power source is situated within said battery compartment.

5. The wrist-mounted illuminating visual warning device of claim 1, wherein said clear lens assembly comprises:

a plurality of light-emitting diodes electrically coupled to said blocking diodes and said secondary control switches respectively; and, a reflector assembly positioned over said clear lens assembly;

wherein light emitted from said light-emitting diodes is projected along said first light path away from said reflector assembly.

6. The wrist-mounted illuminating visual warning device of claim 1, wherein said colored lens assembly comprises: a plurality of light-emitting diodes;

wherein light emitted from said light-emitting diodes is projected along said second light path aligned 180 degrees away from said first light path.

7. The wrist-mounted illuminating visual warning device of claim 1, wherein said flashing modules enable said light-emitting diodes to provide a strobing action;

wherein said flashing modules further enable said light-emitting diodes to alternate between alternating colored lights; and, wherein said flashing modules cooperate with said secondary control switches to enable said flashing module to switch between said strobing action and said alternating colored lights respectively.

8. The wrist-mounted illuminating visual warning device of claim 1, wherein said blocking diodes enable said light emitting diodes to be switched between a first operation and a second operation and a third operation;

wherein said blocking diodes prevent flow of current to said light-emitting diodes of said clear lens assembly when said control switch is in a first position corresponding to said first operation;

wherein said blocking diodes prevent flow of current to said light-emitting diodes of said colored lens assembly when said control switch is in a second position corresponding to said second operation;

wherein said blocking diodes enable flow of current to said light-emitting diodes of said clear lens assembly and said colored lens assembly when said control switch is in a third position corresponding to said third operation; and, wherein current for said light-emitting diodes is regulated by said LED driver circuit.

9. A wrist-mounted illuminating visual warning device freely positional on a forearm of a user to provide a light pattern, said wrist-mounted illuminating visual warning device comprising:

a portable enclosure adapted to be positioned on the forearm of the user;

a clear lens assembly situated at one end of said enclosure;

a colored lens assembly interchangeably situated at another end of said enclosure opposite from said clear lens assembly;

a power source located at said enclosure;

a control switch electrically coupled to said power source;

a plurality of flashing modules;

a plurality of secondary control switches electrically coupled to said flashing modules respectively;

a plurality of blocking diodes electrically coupled to said control switch; and, a LED driver circuit electrically coupled to said power source and said flashing modules respectively;

wherein said clear lens assembly and said colored lens assembly cooperate with said flashing modules and said secondary control switches and thereby emit light along first and second light paths based upon a position of said control switch respectively.

10. The wrist-mounted illuminating visual warning device of claim 9, further comprising: a standoff spacer attached to a rear surface of said enclosure;

a textile strap attached to said standoff spacer; and, an adjustable fastening system located at opposed ends of said textile strap;

wherein said adjustable fastening system and textile strap are adapted to freely position said enclosure on the forearm of the user.

11. The wrist-mounted illuminating visual warning device of claim 10, wherein said standoff spacer is adapted to prevent said first light path and said second light path from being blocked by the forearm of the user.

12. The wrist-mounted illuminating visual warning device of claim 11, wherein said enclosure comprises: a battery compartment having a waterproof cover situated at said rear surface of said enclosure;

wherein said control switch is located on a side of said enclosure; and, wherein said power source is situated within said battery compartment.

13. The wrist-mounted illuminating visual warning device of claim 12, wherein said clear lens assembly comprises:

a plurality of first light-emitting diodes electrically coupled to said blocking diodes and said secondary control switches respectively; and, a reflector assembly positioned over said clear lens assembly;

wherein light emitted from said first light-emitting diodes is projected along said first light path away from said reflector assembly.

14. The wrist-mounted illuminating visual warning device of claim 13, wherein said colored lens assembly comprises: a plurality of second light-emitting diodes;

wherein light emitted from said second light-emitting diodes is projected along said second light path aligned 180 degrees away from said first light path.

15. The wrist-mounted illuminating visual warning device of claim 14, wherein said flashing modules enable said first and second light-emitting diodes to provide a strobing action;

wherein said flashing modules further enable said first and second light-emitting diodes to alternate between alternating colored lights; and, wherein said flashing modules cooperate with said secondary control switches to enable said flashing module to switch between said strobing action and said alternating colored lights respectively.

16. The wrist-mounted illuminating visual warning device of claim 15, wherein said blocking diodes enable said first and second light emitting diodes to be switched between a first operation and a second operation and a third operation;

wherein said blocking diodes prevent flow of current to said first and second light-emitting diodes of said clear lens assembly when said control switch is in a first position corresponding to said first operation;

wherein said blocking diodes prevent flow of current to said first and second light-emitting diodes of said colored lens assembly when said control switch is in a second position corresponding to said second operation;

wherein said blocking diodes enable flow of current to said first and second light-emitting diodes of said clear lens assembly and said colored lens assembly when said control switch is in a third position corresponding to said third operation; and, wherein current for said first and second light-emitting diodes is regulated by said LED driver circuit.

17. A method of utilizing a wrist-mounted illuminating visual warning device that is freely positional on a forearm of a user to provide a light pattern, said method comprising the steps of:

providing and positioning a portable enclosure on the forearm of the user;

providing and situating a clear lens assembly at one end of said enclosure;

providing and interchangeably situating a colored lens assembly at another end of said enclosure opposite from said clear lens assembly;

providing and locating a power source at said enclosure;

providing and electrically coupling a control switch to said power source;

providing a plurality of flashing modules;

providing and electrically coupling a plurality of secondary control switches to said flashing modules respectively;

providing and electrically coupling a plurality of blocking diodes to said control switch;

providing and electrically coupling a LED driver circuit to said power source and said flashing modules respectively; and, said clear lens assembly and said colored lens assembly cooperating with said flashing modules and said secondary control switches and thereby emitting light along first and second light paths based upon a position of said control switch respectively.

* * * * *